US007000361B1

(12) United States Patent
Merriman et al.

(10) Patent No.: US 7,000,361 B1
(45) Date of Patent: Feb. 21, 2006

(54) METHOD OF CREATING A CONCRETE PAVED AREA

(75) Inventors: Patrick J. Merriman, Portland, OR (US); William Nicholas Merriman, Portland, OR (US)

(73) Assignee: Masons Supply Company, Portland, OR (US)

( * ) Notice: Subject to any disclaimer, the term of this patent is extended or adjusted under 35 U.S.C. 154(b) by 131 days.

(21) Appl. No.: 10/810,015

(22) Filed: Mar. 26, 2004

(51) Int. Cl.
*E04G 21/00* (2006.01)

(52) U.S. Cl. ..... 52/742.1; 404/75; 52/747.1

(58) Field of Classification Search ..... 52/747.12, 52/747.11, 746.12, 746.1, 222, 231, 742.1; 404/19, 27–31, 82, 75, 34
See application file for complete search history.

(56) References Cited

U.S. PATENT DOCUMENTS

| | | | | |
|---|---|---|---|---|
| 4,080,087 | A | 3/1978 | Phillips | 404/72 |
| 4,131,406 | A | 12/1978 | Fresquez | 425/385 |
| 4,351,694 | A | 9/1982 | Mathis | 156/574 |
| 4,397,581 | A | 8/1983 | Jarvis | 404/97 |
| 4,620,816 | A | 11/1986 | Kupfer | 404/6 |
| 4,678,364 | A | 7/1987 | Charonnat et al. | 404/105 |
| 4,715,743 | A | 12/1987 | Schmanski | 404/9 |
| 4,776,723 | A | 10/1988 | Brimo | 404/89 |
| 4,934,863 | A | 6/1990 | Brantner, Jr. | 404/87 |
| 4,993,867 | A | 2/1991 | Usow | 404/89 |
| 5,061,172 | A | 10/1991 | Fennessy, Sr. | 425/385 |
| 5,133,621 | A | 7/1992 | Gonzales | 404/72 |
| 5,271,690 | A | 12/1993 | Fennessy, Sr. | 404/9 |
| 5,303,669 | A | 4/1994 | Szekely | 116/205 |
| 5,385,770 | A | 1/1995 | Julnes | 428/195 |
| 5,775,835 | A | 7/1998 | Szekely | 404/34 |
| 6,153,282 | A | 11/2000 | Dickinson et al. | 428/141 |
| 6,449,790 | B1 | 9/2002 | Szekely | 14/69.5 |
| 6,796,095 | B1 * | 9/2004 | Azar et al. | 52/371 |
| 6,890,124 | B1 * | 5/2005 | Provenzano, III | 404/73 |
| 2002/0059768 | A1 | 5/2002 | Blount | 52/600 |
| 2003/0037720 | A1 | 2/2003 | Stockton | 116/205 |
| 2003/0084523 | A1 | 5/2003 | Szekely | 14/69.5 |

FOREIGN PATENT DOCUMENTS

JP 2005047233 A * 2/2005

OTHER PUBLICATIONS

ADA Accessibility Guidelines for Buildings and Facilities (ADAAG); www.access-board.gov/adaag/html/adaag.htm; amended through Sep. 2002; pp. 52 and 115.
Armor-Tile Tactile Systems brochure; Engineered Plastics Inc., Williamsville, NY 14221; www.armor-tile.com.
E-Z-Set Ceramic Composite Detectable Warning Panels brochure; Detectable Warning Systems Inc., Orange, CA 92867; www.detectable-warning.com.

(Continued)

*Primary Examiner*—Naoko Slack
(74) *Attorney, Agent, or Firm*—Law Office of Timothy E. Siegel; Timothy E. Siegel

(57) ABSTRACT

A method of providing a paved area having a predetermined set of surface features. The method begins with the pouring of wet concrete into a predetermined area. Then a predetermined thickness of the wet concrete is removed in a predetermined portion of the predetermined area, thereby creating a lower, upwardly facing surface in the predetermined portion. At this point, a paving tile having the predetermined set of surface features is placed on the lower, upwardly facing surface. Finally, the wet concrete underneath and about the paving tile is permitted to cure.

20 Claims, 3 Drawing Sheets

OTHER PUBLICATIONS

Hanover Detectable Warning Paver brochure; Hanover Architectural Products, Hanover, PA 17331; www.hanover-pavers.com.

Wausau Tile Detectable Warning Pavers brochure; Wausau Tile, Terra-Paving Division, Wausau, WI 54402; www.wausautile.com.

* cited by examiner

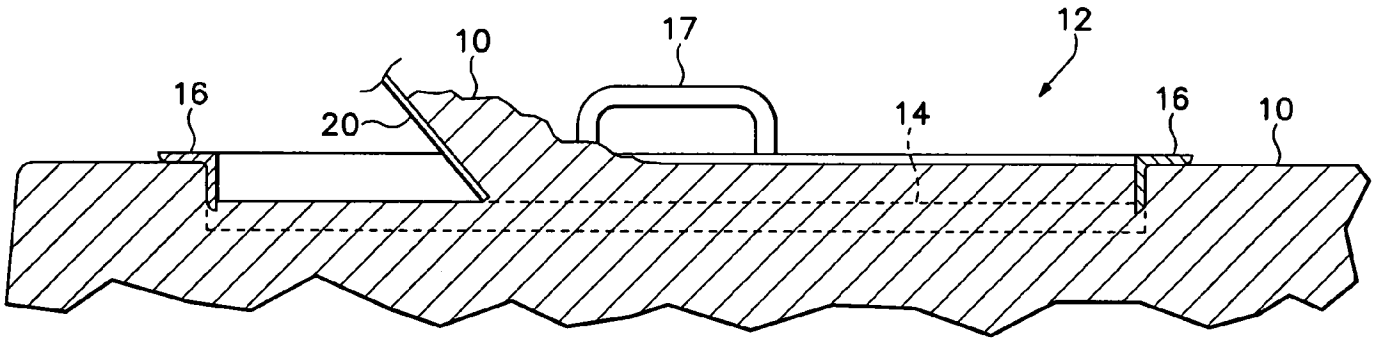
FIG.4
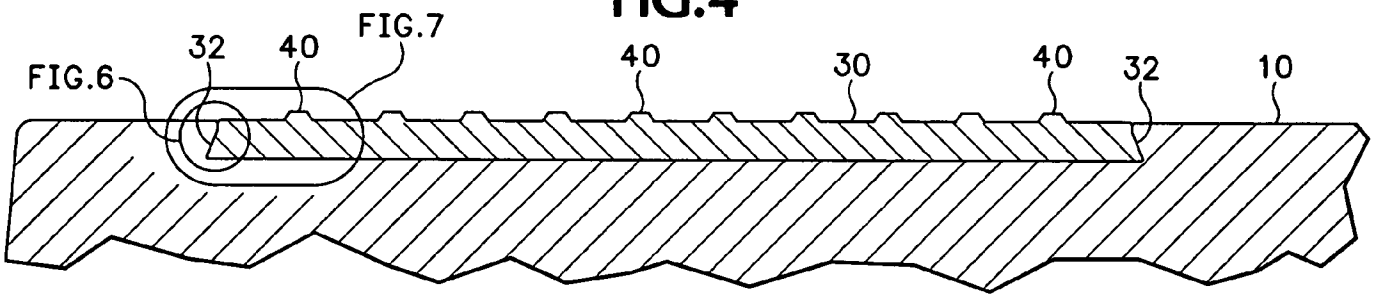
FIG.5
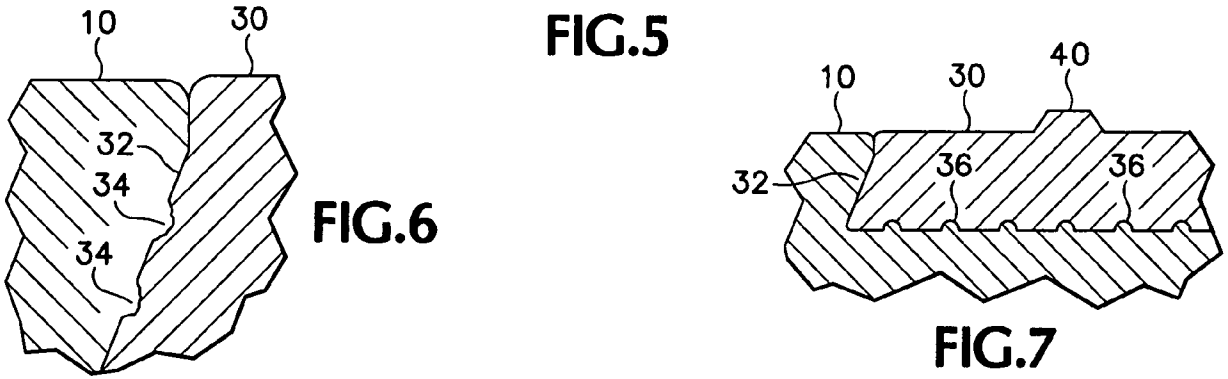
FIG.7
FIG.6

METHOD OF CREATING A CONCRETE PAVED AREA

BACKGROUND OF THE INVENTION

The present invention relates to concrete paving.

The technology for providing concrete paving that has surface features has become an important field of endeavor with the advent of Americans with Disabilities Act (ADA) current guidelines requirement for detectable warnings on walking surfaces. These detectable warnings must be a grid of raised truncated domes with a diameter of 23 mm (0.9 in) at the base and 10 mm (0.4 in) at the top, a height of 5 mm (0.2 in) and a center-to-center spacing between nearest neighbors of 60 mm (2.35 in).

A number of different technologies have evolved to create the detectable warnings. First there is a polymer molded product that is about 5 mm (0.1875 in) thick and is provided in the form of tiles having flanges that extend downwardly by 3.5 cm (1.375 in). To install this product, the flanges are pressed into wet concrete. This material is light, and therefore easy to bring to the worksite. It may form a strong bond with the concrete that it is applied onto. Moreover, the fact that it is applied onto wet concrete is a great advantage, as it can be applied at the same time as the concrete is poured, unlike some other methods that are described below. The general term for this type of product is a "wet set" plastic tile.

A number of other surface feature-bearing elements exist, including precast concrete blocks, on the order of 5 cm (2 in) thick, brick pavers, glue down plastic elements, glue down rubber mat and hot applied mat. Unfortunately, for each one of these options, the installer must first pour a concrete substrate, wait 28 days for the concrete to thoroughly set, and then return to apply the surface feature bearing elements. This has been heretofore necessary for any product that had a thickness of more than a few millimeters, as the surface bearing element would otherwise protrude upwardly above the surrounding surface. Precast concrete blocks have had the particular problem that they are so heavy that if set into wet concrete such a block would press down so heavily as to push the wet concrete up around the sides of the concrete block. Any glue down product must be adhered to a finished substrate in order to gain a strong adhesion. Moreover, brick pavers must be laid on an even finished surface. Because they are supported by a substrate that is already solid at the time of installation, all of these products tend to have substantially planar bottom surfaces.

In a separate sequence of developments, prestressed concrete has been available for many years, with improvements gradually being made to the production process and the resultant product. A relatively recent advancement is described in U.S. Patent Application Publication 2002/0059768 ("the application"), which is incorporated by reference as if fully set forth herein. The application describes a method for producing a thin, lightweight prestressed concrete panel by balancing the tendons about a center plane of the panel. There appears to be no suggestion in the application that the panels thereby produced could be beneficially used as paving tiles.

Moreover, at first assessment, it would seem to many of those familiar with the technology of concrete installations that the use of this type of panel for paving would be limited to applications in which a substrate of cured concrete first must be provided. This appears to be how the previously available concrete blocks and all of the adhered paving elements have been installed. Moreover, the added expense of using prestressed concrete for applications in which there is not a structural requirement to do so, would not appear practical.

SUMMARY OF THE INVENTION

In a first separate aspect, the present invention is a method of providing a paved area having a predetermined set of surface features. The method begins with the pouring of wet concrete into a predetermined area. Then a predetermined thickness of the wet concrete is removed in a predetermined portion of the predetermined area, thereby creating a lower, upwardly facing surface in the predetermined portion. At this point, a paving tile having the predetermined set of surface features is placed on the lower, upwardly facing surface. Finally, the wet concrete underneath and about the paving tile is permitted to cure.

In a second separate aspect, the present invention is a method of removing a predetermined area and depth of formable material from an expanse of the formable material having a top surface. The method makes use of a shovel guide tool, comprising at least one shovel guide having a top surface; a depth indicator having a bottom surface at a height above the shovel guide substantially equal to the predetermined depth; and an area indicator, indicating an area equal to the predetermined area. The shovel guide tool is pushed into the formable material until the bottom surface of the depth indicator is level with the formable material top surface, thereby pushing the shovel guide top surface to the predetermined depth. Then a shovel is pushed into the deformable material until it encounters the top surface of the at least one shovel guide and it is run along the top surface until it is at least partially filled with deformable material. The shovel is emptied at a location away from the shovel guide tool. The shoveling process is continued until the area indicated by the area indicator is cleared of formable material down to the top surface of the at least one shovel guide.

In a third separate aspect, the present invention is a structure that includes a layer of wet concrete. A concrete tile having side surfaces and having a top surface bearing surface features is supported by the wet concrete. The structure also includes wet concrete that abuts the side surfaces of the concrete tile.

In a fourth separate aspect, the present invention is a structure that a prestressed concrete tile having a bottom major surface, side edges and a top major surface. A unitary body of concrete supports the bottom major surface of the concrete tile and contacts the side edges of the concrete tile. In addition, the bottom major surface and side edges of the concrete tile are adhered to the unitary body of concrete.

The foregoing and other objectives, features and advantages of the invention will be more readily understood upon consideration of the following detailed description of the preferred embodiment(s), taken in conjunction with the accompanying drawings.

BRIEF DESCRIPTION OF THE DRAWINGS

FIG. 4 is a side view of the elements of FIG. 3, also showing a shovel being moved along the shovel guide tool, according to a further step of the preferred method of the present invention.

FIG. 5 is a side view of a finished concrete installation, which may be a result of the method partially shown in FIGS. 2, 3 and 4 and is in itself a preferred embodiment of the present invention.

FIG. 6 is a greatly enlarged partial side view of the finished concrete installation of FIG. 5.

FIG. 7 is a partial side view of the finished concrete installation of FIG. 5, which is enlarged relative to FIG. 5.

DETAILED DESCRIPTION OF THE PREFERRED EMBODIMENTS

Figure 1:
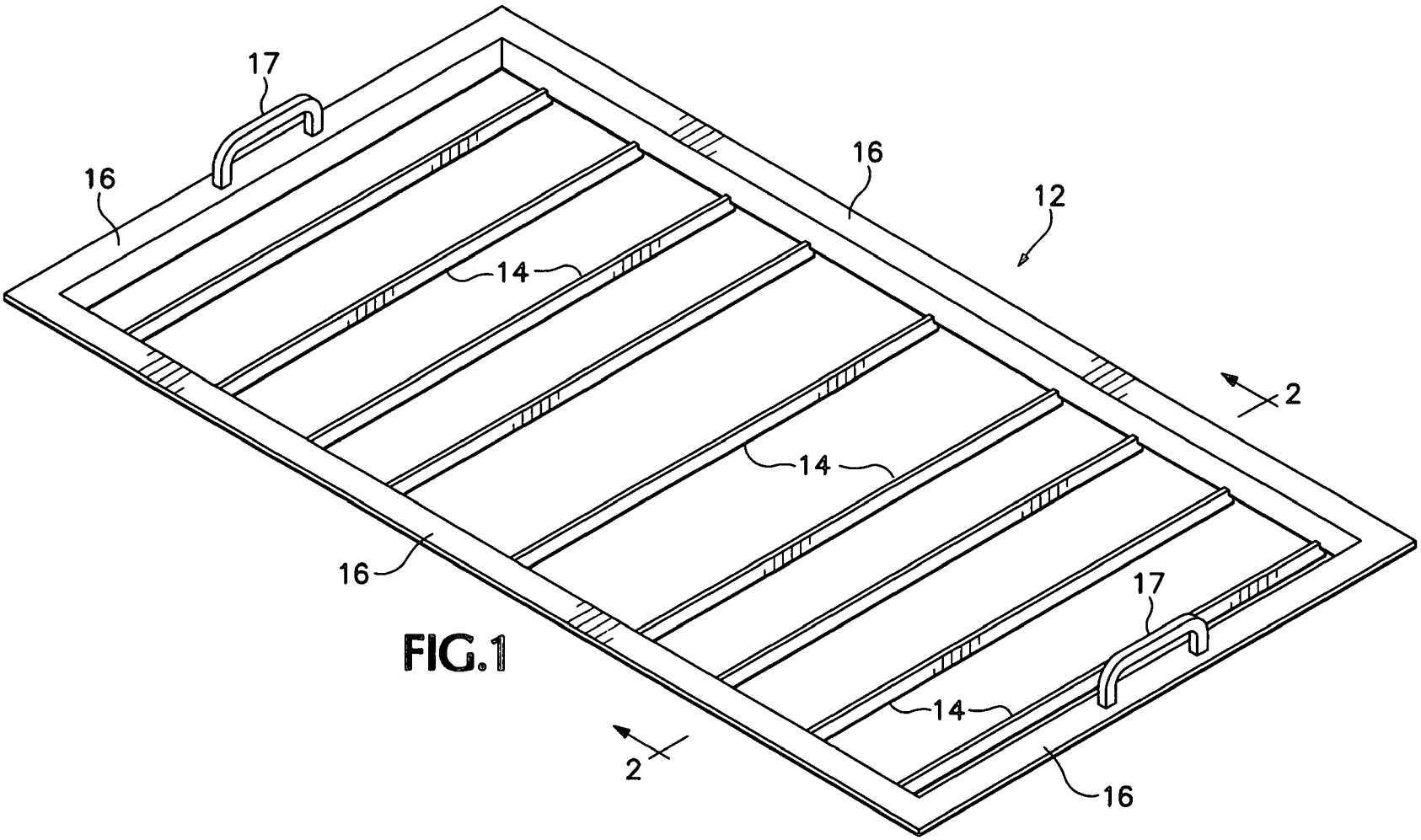
FIG. 1 is a perspective view of a shovel guide tool according to a preferred embodiment of the present invention.
Figure 2:
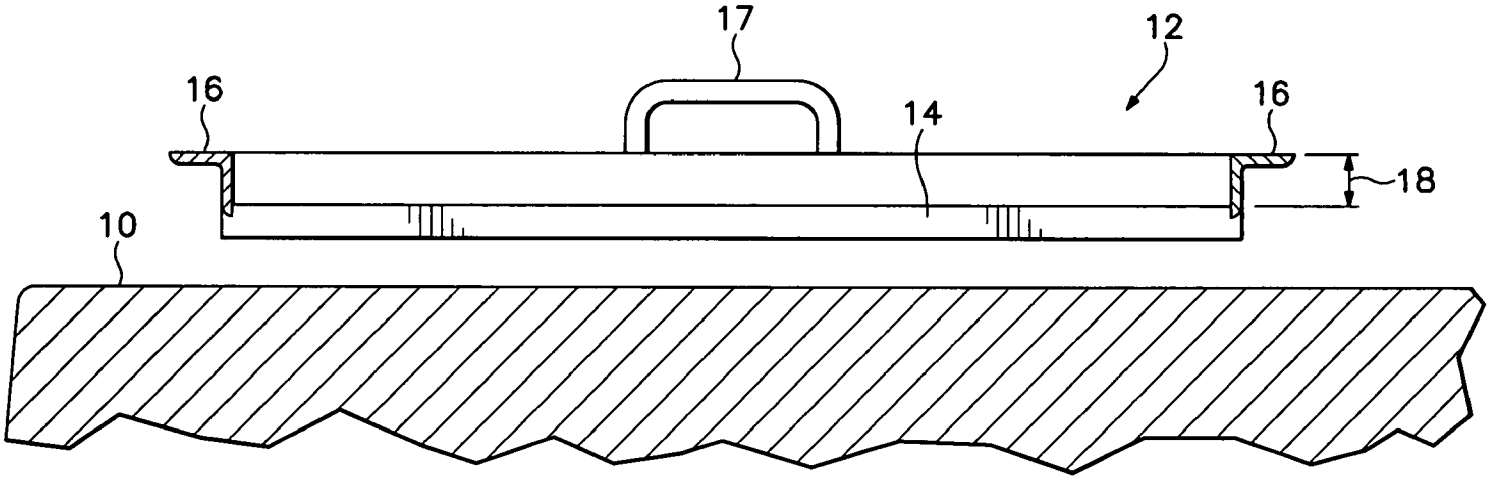
FIG. 2 is a side of the shovel guide tool of FIG. 1 being positioned above an expanse of formable material, according to a step of a preferred method of the present invention.
Figure 3:
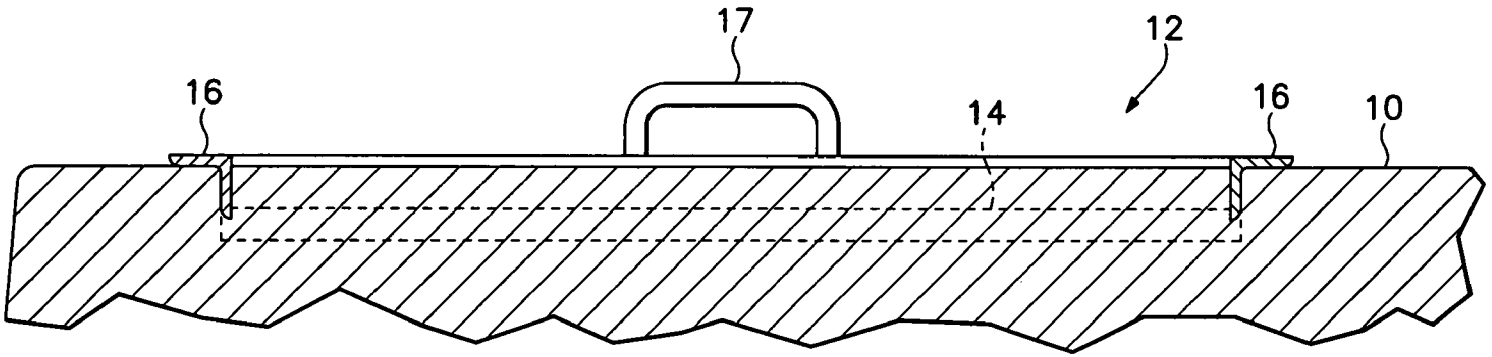
FIG. 3 is a side view of the elements shown in FIG. 2 with the shovel guide tool pressed into the formable material, according to a further step of a preferred method of the present invention.

A first preferred method of the present invention is a method of removing a predetermined area and depth of wet concrete (FIG. 2), or other formable material, from an expanse of the wet concrete 10. This is most typically done for the purpose of setting a tile of matching area and thickness (see below). This method makes use of a shovel guide tool 12, comprising a set of shovel guides 14, in the form of ribs. A depth and area indicator 16, is in the form of a rectangular frame having handles 17. Indicator 16 has a bottom surface that is at a height 18 (FIG. 2) above the tops of shovel guides 14 that is substantially equal to the predetermined depth. The shovel guide tool 12 is pushed into the wet concrete 10 until the bottom surface of the depth indicator 16 is level with the top surface of the wet concrete 10, thereby pushing the top surface of the shovel guides 14 to the predetermined depth.

A shovel 20 is pushed into the wet concrete until it encounters the top surfaces of the shovel guides 14 and is run along these top surfaces until it is at least partially filled with wet concrete 10. The shovel 20 is emptied at a location away from the shovel guide tool 12. The shoveling process is continued until the area indicated by the area indicator 16 is cleared of wet concrete 10 down to the top surfaces of the shovel guides 14.

At this point a depression of predetermined depth and area has been created in the wet concrete. In a preferred embodiment guide tool 12 is constructed to create a depression of exactly the right area and depth to accommodate a concrete tile 30. Tile 30 may have a width of about 0.6 meters (approximately 2 feet) and may be either about 0.6, 0.75 or 0.9 meters (approximately 2, 2.5, or 3 feet) long. In a preferred method a 3 mm (⅛ in) coat of mortar is applied to the bottom of tile 30 immediately prior to installation. Tile 30 is then placed into the depression created and concrete 10 is compacted and finished about it. Additional wet concrete 10 may be added to help retain a set of wedge sections 32 of tile 30.

The above described process creates a structure in which tile 30 is supported from the bottom and contacted on the sides by wet concrete 10. After concrete 10 has cured, this structure is set, with tile 30 being similarly supported and contacted by cured concrete. In a preferred embodiment, tile 30 defines pores 34 (FIG. 6), some of which are at least partially filled with concrete 10. Also, the bottom surface of tile 30 is indented with a set of furrows 36 (FIG. 7) that facilitate the formation of an interlocked bond with the underlying concret 10. The structure created, in which tile 30 is supported and held in place by surrounding concrete 10 is of particular strength. Moreover, it is very resilient to compression and shear, as may be encountered by a concrete installation when trucks either pass by the installation or pass at least partially over the installation.

Tile 30 may have surface features, such as a grid of truncated domes 40. As noted in the background section, domes 40 serve as detectable warnings, and are mandated by the ADA guidelines for various installations including curb cuts, train station platforms, hazardous vehicular crossings and reflecting pool edges. In some instances a grid having a width of 0.9 meter (@ 3 ft) is required, instead of the standard 0.6 meters (@ 2 ft). Under the current guidelines, domes 40 must have a diameter of 23 mm (0.9 in) at the top and 10 mm (0.4 in) at the top, a height of 5 mm (0.2 in) and a center-to-center spacing of 60 mm (2.35 in) between nearest neighbors. Tiles, similar to tile 30, may be used for other purposes. Among these are adding strength to a concrete paved area; adding a colorful design to an area; adding artistic surface protrusions; and having a set of surface features or a surface shape that facilitates water drainage.

In one preferred embodiment, tile 30 is of a make generally described in U.S. Patent Application Publication 2002/0059768, which has been incorporated by reference. In an alternative preferred embodiment a concrete paving tile of a differing construction is used. In one preferred embodiment a set of tendons are added that place the bottom half of paving tile 30 under more compressive stress than the top half. As paving tile 30 is supported by concrete material 10, this unequal compressive stress is, in some instances, beneficial.

In many types of installations it is beneficial to have a thicker layer of concrete material underneath and supporting tile 30 than elsewhere. In a curb cut installation, wet concrete 10 is formed to a sloping grade prior to the installation of tile 10, rather than being level.

In a preferred embodiment, tiles 30 are cast in 0.6 m (2 ft) by 2.4 m (8 ft) by 2.22 cm (0.875 in) sections and are cut in the shop into 0.6 m by 0.6 m, 0.75 m or 0.9 m (2 ft, 2.5 ft or 3 ft) sections. In addition, because tiles 30 are substantially uniform in cross section they may be cut at the job site to accommodate local features. For example, a vault box or a bollard may be accommodated by cutting the tile 30 into an accommodating shape. This task may be a difficult or impossible if using tiles that cannot be modified from the standard, factory provided shapes. Such tiles appear to include the wet set plastic tiles and the concrete blocks described in the background section.

The terms and expressions that have been employed in the foregoing specification are used as terms of description and not of limitation. In particular, the term concrete, wherever it is used in this application, refers to any cementitious material generally used in construction, for example a mixture of cement and sand, commonly known as "mortar" is considered to be "concrete" in this application. There is no intention, in the use of such terms and expressions, of excluding equivalents of the features shown and described or portions thereof, it being recognized that the scope of the invention is defined and limited only by the claims which follow.

The invention claimed is:

1. A method of providing a paved area having a predetermined set of surface features, said method comprising:

(a) providing a paving tile having said predetermined set of surface features;

(b) pouring wet concrete into a predetermined area;

(c) removing a predetermined thickness of said wet concrete in a predetermined portion of said predetermined area, thereby creating a lower, upwardly facing surface in said predetermined portion;

(d) placing said paving tile on said lower, upwardly facing surface; and (e) permitting said wet concrete underneath and about said paving tile to cure.

2. The method of claim 1 wherein said paving tile is a concrete paving tile.

3. The method of claim 2 wherein said concrete paving tile is a pre-stressed concrete paving tile.

4. The method of claim 1, wherein said paving tile has a top surface and said predetermined set of surface features are protrusions from said top surface.

5. The method of claim 4, wherein said protrusions are truncated domes.

6. The method of claim 1, wherein said paving tile is less than 4 cm (1.57 in) thick.

7. The method of claim 1, wherein said paving tile includes a bottom surface and wherein an adhesive is spread on said bottom surface prior to step (d).

8. The method of claim 1 further including the installation of additional paving tiles adjacent to said paving tile.

9. The method of claim 8 wherein said additional paving tiles also include surface features.

10. The method of claim 1 wherein step (c) creates an indentation in said predetermined area of said wet concrete that is sized and shaped to accommodate at least a single paving tile and is approximately the depth of a single paving tile.

11. The method of claim 1 wherein step (c) creates an indentation in said predetermined area of said wet concrete that is sized and shaped to accommodate two paving tiles placed side by side and that is approximately the depth of a single paving tile.

12. The method of claim 1 wherein step (c) is accomplished with the aid of a tool that includes a frame that is pushed into the wet concrete, said frame having an interior volume that is the size and shape of an integer number of paving tiles placed side by side.

13. The method of claim 12 wherein said integer number of paving tiles is one.

14. The method of claim 12 wherein said integer number of paving tiles is two.

15. The method of claim 12 wherein said tool has a handle attached to said frame and adapted to facilitate said step of pushing said tool into said wet concrete.

16. The method of claim 12 wherein said tool includes at least one shovel guide at said frame bottom, and wherein a tool user moves his shovel along said top of said shovel guide in removing said wet concrete.

17. The method of claim 1 wherein said wet concrete is more specifically a mixture including Portland cement and sand.

18. The method of claim 1 wherein said paved area is a part of a sidewalk.

19. The method of claim 1 wherein in step (d) said paving tile is placed entirely on said lower upwardly facing surface created in step (c).

20. The method of claim 1 wherein said paving tile is made of reinforced concrete.

* * * * *